United States Patent [19]

Robertson

[11] Patent Number: 4,966,402

[45] Date of Patent: Oct. 30, 1990

[54] AERIAL LIFT SUPPORT FRAME

[76] Inventor: James Robertson, 6401 East Rogers Cir., Suite 1, Boca Raton, Fla. 33487

[21] Appl. No.: 341,582

[22] Filed: Apr. 21, 1989

[51] Int. Cl.[5] ..... B66C 23/06

[52] U.S. Cl. ..... 296/43; 212/182

[58] Field of Search ..... 212/180, 181, 182; 296/3, 43; 280/763.1

[56] References Cited

U.S. PATENT DOCUMENTS

| | | | |
|---|---|---|---|
| 3,797,672 | 3/1974 | Vermette | 212/180 |
| 3,804,263 | 4/1974 | Castonguay | 212/180 |
| 3,836,024 | 9/1974 | Mantino | 212/180 X |
| 3,888,368 | 6/1975 | Hawkins | 212/180 X |
| 4,407,419 | 10/1983 | Clements | 212/189 |
| 4,700,851 | 10/1987 | Reeve et al. | 212/181 |

*Primary Examiner*—Charles A. Marmor
*Assistant Examiner*—Michael Mar
*Attorney, Agent, or Firm*—Malin, Haley, McHale, DiMaggio & Crosby

[57] ABSTRACT

A table-mount type aerial lift support frame wherein the aerial lift boom and turret as well as a portion of the support base frame are removably connected to the carrier vehicle chassis. The support frame is comprised of a rectangular arrangement of frame members rigidly connected to relatively short support legs, which in turn are removably received by corresponding frame stanchions. The frame stanchions are rigidly connected to the chassis by way of a novel flange plate. The wide-pread placement of the frame stachions and, correspondingly, the support legs yields a widespread distribution of loading on the carrier vehicle chassis and consequent increased resistance to tortional forces and stresses. The aerial lift support frame structure of the present invention provides an unusually wide stance both in width and length thereby making integral connection with the carrier vehicle chassis at points sufficiently distant from one another so that the static and dynamic loading on the chassis does not result in undue twisting thereof.

5 Claims, 2 Drawing Sheets

AERIAL LIFT SUPPORT FRAME

BACKGROUND OF THE INVENTION

1. Field of the Invention

This invention relates generally to cherry-picker-type aerial lift support apparatus, and more specifically relates to a table mount-type frame removably associated with a mobile vehicle, said frame adapted to support an extensible aerial lift arm but while reducing tortional fatigue to the vehicle frame over time.

2. Prior Art

The widespread use of aerial support lifts on mobile carriers has given rise to a variety of configurations so as to satisfy a particular need. As the safety of a human operator is placed in peril by being raised to relatively great heights in the cherry-picker bucket attached to the extensible aerial lift boom which in turn is connected to the carrier vehicle, the configuration of the boom, turret and support frame must be designed to allow a minimum of deflection of the vehicle subframe or chassis from movement of the boom and turret. The most common remedy for suppressing undesired structural deflections is to use extendible feet means such as shown in elements 66 and 67 of U.S. Pat. No. 4,700,851 to Reeve et al. Such feet means, however, add to the cost of a lifting apparatus, therefore leaving an alternate embodiment preferred.

It is also necessary in the course of operating such aerial lifts to either repair the lift apparatus itself or the carrier vehicle without disabling the carrier vehicle or aerial lift apparatus, respectively. For other reasons, removable aerial lift assemblies have been proposed, particularly in U.S. Pat. No. 4,407,419, which discloses a portable boom support but which relies on lateral extensible outriggers for lateral stability. Also, U.S. Pat. No. 4,700,851 discloses a portable lift and frame assembly which also relies on extensible feet as referred to supra. In addition, U.S. Pat. No. 3,888,368 discloses an adjustable wrecker attachment having a base frame the proportions of which can be adjusted.

In structures of the type herein described, it has been customary to refer to mounting structures as being either of the bridge-mount type or the table-mount. The bridge-mount type frame has a relatively narrow stance and would be applicable for low loading force conditions. On the other hand, the table-mount type frame has a wider stance both laterally and longitudinally, and is used under higher loading conditions so as to provide higher structural resistance to said loading.

SUMMARY OF THE INVENTION

Nothing in the prior art teaches the use of a tablemount type aerial lift support frame wherein the aerial lift boom and turret as well as a portion of the support base frame are removably connected to the carrier vehicle chassis. The aerial lift frame structure of the present invention provides an unusually wide stance both in width and length thereby making integral connection with the carrier vehicle chassis at points sufficiently distant from one another so that the static and dynamic loading on said chassis does not result in undue twisting of said chassis. Tortional fatigue of the carrier vehicle chassis could lead to failure thereof while the aerial lift is in use, which may yield a catastrophic outcome.

The primary purpose of this invention is, therefore, to provide an aerial lift and support frame assembly having widely spaced apart support legs resulting in a design which presents resistance to tortional fatigue of the carrier vehicle chassis.

It is also a primary object of the present invention to provide a aerial lift boom and turret arrangement which is removably connectable to a carrier vehicle support frame and chassis so as to provide for the removal thereof from said carrier vehicle for maintenance of either the aerial lift or the carrier vehicle.

It is also an object of this invention to provide an aerial lift support frame of the table mount variety which has generally vertically oriented support stanchions connected between said aerial lift and the carrier vehicle that are spaced apart a relatively great distance so as to free up usable space within the interior of the carrier vehicle body.

DETAILED DESCRIPTION OF THE PREFERRED EMBODIMENT

Figure 1:
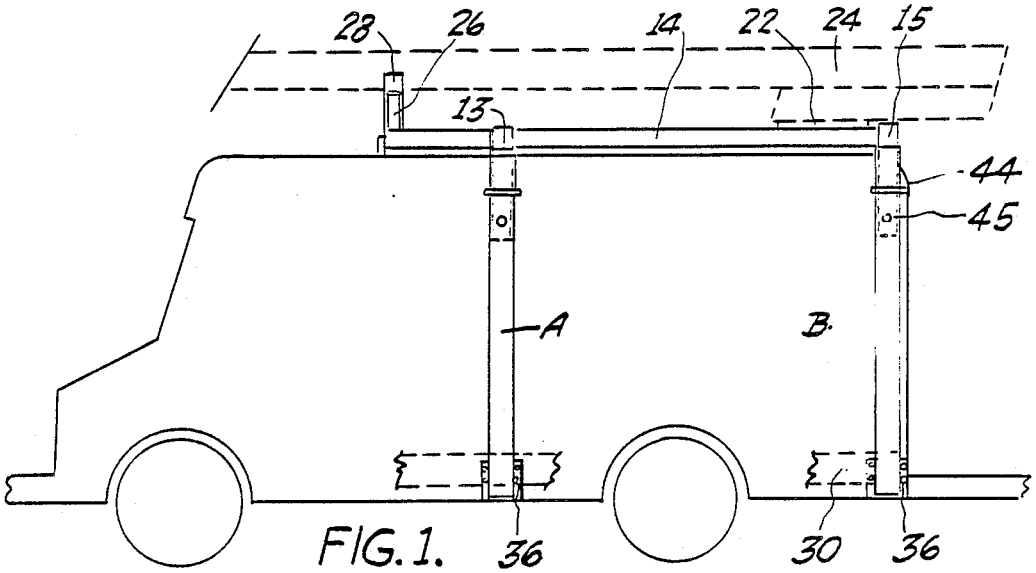
FIG. 1 is a cut-away side elevational of a carrier vehicle showing the aerial lift support frame in relationship to said carrier vehicle.
Figure 2:
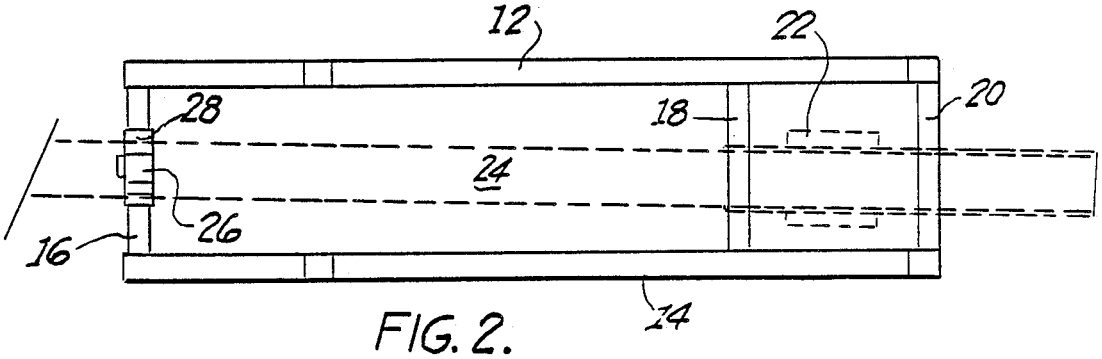
FIG. 2 is a plan view of the aerial lift support base.

Referring now to the drawings, FIG. 1 shows a carrier vehicle 11 adapted to support an aerial lift boom and turret arrangement by means of a novel aerial lift support frame arrangement 10. Said support frame 10 is comprised of a rectangular arrangement of frame members 12, 14, 16, 18 and 20 as best shown in FIG. 2. Side members 12 and 14 are generally parallel and are spanned by transverse support members 16, 18 and 20. Members 18 and 20 are adapted to support the turret 22 and boom 24 arrangement and to distribute the load generated by the weight of the turret and boom, including the weight of the user in bucket 25. A boom support bracket 26 is integrally connected to transverse brace 16 at about its mid-point. A resilient boom contact portion 28 may be used in conjunction with said support bracket 26.

Figure 4:
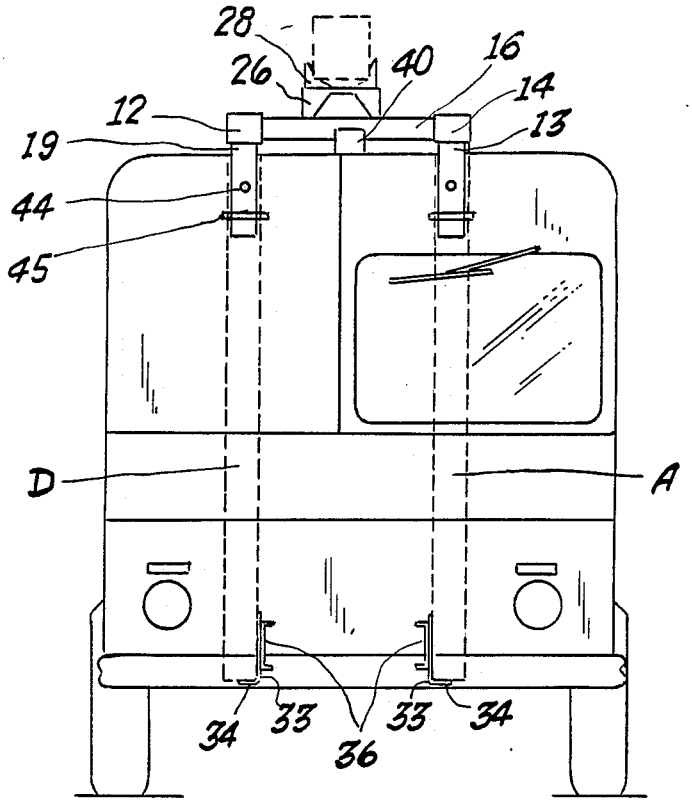
FIG. 4 is a front view cut-away elevation showing the invention.

As best shown in FIG. 4, an additional short support leg 40 may be attached between frame 10 and vehicle 11 to provide additional structural rigidity. Any number of additional such leg members 40 may be interposed at various positions on frame 10.

Frame members 12, 14, 16, 18 and 20 have connected thereto vertical, relatively short, leg members 13, 15, 17 and 19, adapted to be received by frame stanchions A, B, C and D, respectively. Pin 44 and bolt 45 may be used to releasably secure the upper frame portion (members 12, 14, 16, 18 and 20) from frame stanchions A, B, C and D.

Figure 3:
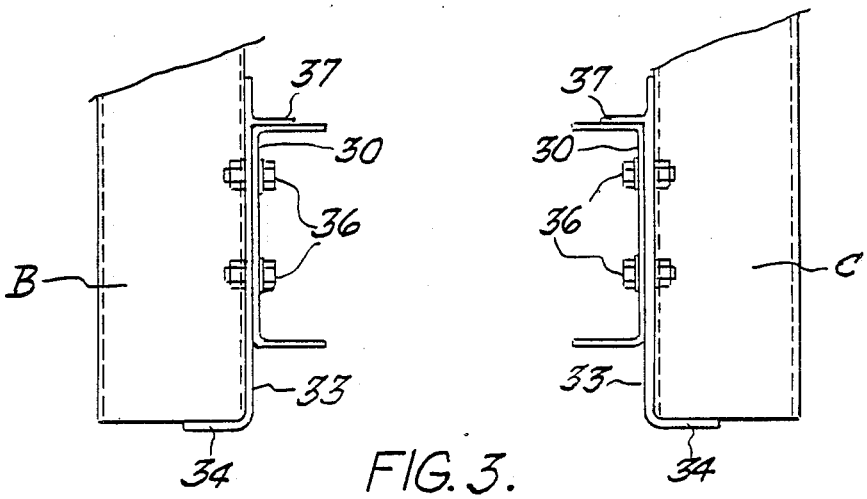
FIG. 3 is a detail of the chassis/support frame leg connection taken from the rear of the truck.

As seen in FIG. 3, said stanchions A, B, C and D are rigidly connected to truck frame 30 by a plurality of connecting means 36. In the preferred embodiment, the interconnection of said stanchions with said frame is facilitated and strengthened by use of a flange plate 33 sandwiched between said stanchions A, B, C and D, and truck frame rail 30. Said flange 33 is generally J-shaped and has an upper support tab 37 generally horizontally disposed and a lower support tab 34 which is also generally horizontally disposed and facing in the opposite direction of tab 37. Tab 37 supports stanchions A through D against horizontal movement relative to vehicle frame rails 30. Tab 34 performs the same function by supporting the lower end of said stanchions A through D.

The removability of upper support frame members 12, 14, 16, 18 and 20 is facilitated by the use of retention pins 44 and removable connecting means 45 as best shown in FIGS. 1 and 4. In this manner, a plurality of vehicles and boom and turret arrangements may be used interchangeably as when, for instance, the vehicle becomes inoperative or the boom and turret arrangement becomes inoperative. In such case, the now functioning apparatus can be separated from the properly functioning apparatus and replaced by better working equipment. This flexibility diminishes the down time associated with mobile aerial lift apparatus common to all industries using such equipment.

Figure 5:
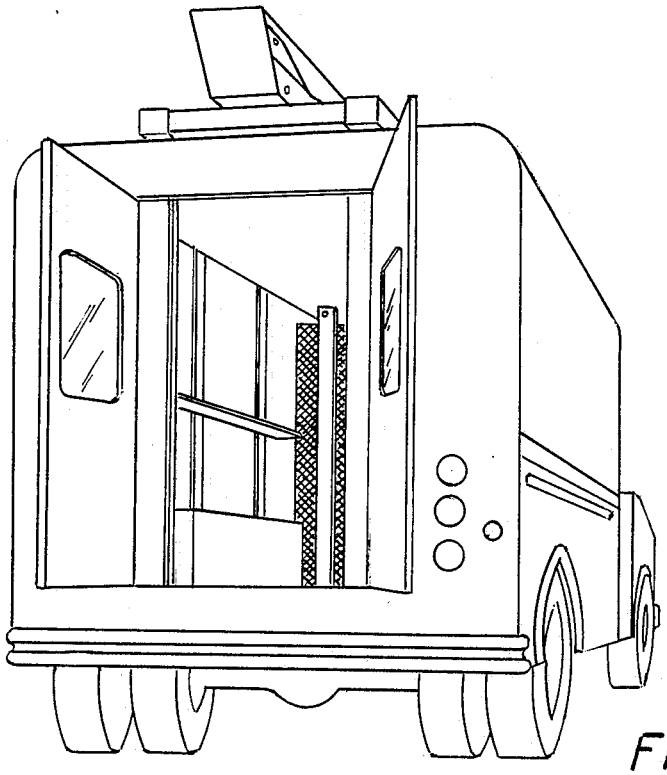
FIG. 5 is a rear view of the carrier vehicle showing a part of the interior thereof.

FIG. 5 shows a rear view highlighting the additional benefits inherent in the novel design disclosed herein. Namely, arrangements heretofore placed into use significantly reduce the open area within the carrier vehicle body. Such a waste of space normally requires the use of an additional vehicle to carry supplies and tools. In the instant invention, the widespread placement of the stanchions A through D frees up a substantial portion of the interior of the vehicle body allowing for the placement therein of tools, other equipment and supplies.

The widespread placement of stanchions A through D and the rigid manner in which they are connected to vehicle chassis rails 30, provides the primary benefit of the instant invention. In prior art configurations, the tremendous tortional loads placed on the carrier vehicle as a result of the extension and/or movement of the boom arm cause a time dependent structural fatigue to occur to the vehicle. This fatigue will likely ultimately lead to failure in some portion of the vehicle and potentially to human injury. This invention seeks to overcome this inherent drawback by distributing the points of contact of the support frame stanchions A through D at generally widely spaced apart positions. In the preferred embodiment, the front stanchions A and D are placed as close to the driver's compartment as practicable.

The instant invention has been shown and described herein in what it is considered to be the most practical and preferred embodiment. It is recognized, however, that departures may be made therefrom within the scope of the invention and that obvious modifications will occur to a person skilled in the art.

What is claimed is:

1. A wide-stanced table mount type support frame for supporting an aerial lift apparatus on a carrier vehicle, said carrier vehicle comprised in part of a vehicle body supported by horizontal rail frame members, the support frame comprising:

a generally elongated rectangular frame means adapted for connection between said aerial lift apparatus and a carrier vehicle means for transporting said aerial lift apparatus;

a plurality of leg means extending generally vertically downwardly from said rectangular frame means;

a corresponding number of generally vertically disposed stanchions adapted to receive said leg means in releaseable engagement, said stanchions being rigidly affixed to the body and horizontal rail frame members of said carrier vehicle;

means for releasably connecting said leg means to said stanchions;

wherein said stanchions are spaced apart from front to rear and from side to side with respect to said vehicle a generally substantial distance relative to the length overall and the longitudinal center line of the vehicle respectively; and means for rigidly affixing said stanchions to said carrier vehicle frame comprising:

a flange plate having a vertical portion sandwiched essentially vertically between the lower portion of each said stanchion and a corresponding one of said rail frame members, said flange plate further having a first tab projecting essentially horizontally from said flange plate in a direction away from the longitudinal center-line of said carrier vehicle frame, said first tab extending under the bottom of said stanchion thereby supporting said stanchion, a second tab connected at a point vertically above said first tab but on the opposite side of said flange plate relative to said first tab, said second tab projecting essentially horizontally away from said flange plate in a direction toward the longitudinal center-line of said carrier vehicle, said corresponding one of said rail frame members extending beneath said second tab for supporting said flange plate, and fastener means for fixedly securing said flange plate and said stanchion to said corresponding one of said rail frame members.

2. The device of claim 1 wherein said means for releasably connecting said leg means to said stanchions comprises at least one retaining pin and at least one bolt for each of said leg means and corresponding said stanchions, each said pin and said bolt being releasably connected through said leg means and said stanchions respectively when said leg means are disposed within said stanchions.

3. The device of claim 2 wherein each of said plurality of corresponding retaining pins and said bolts are disposed at right angles to each.

4. The device of claim 2, wherein said plurality of leg means comprises four leg means and said plurality of stanchions comprises four correspondingly spaced apart stanchions.

5. The device of claim 1, further comprising an aerial lift support member integrally connected to said frame means near the front thereof, said support means having a resilient aerial lift receiving member means.

* * * * *